US011297891B2

(12) United States Patent
Levesque et al.

(10) Patent No.: US 11,297,891 B2
(45) Date of Patent: Apr. 12, 2022

(54) HELMET ASSEMBLY WITH VISOR ASSEMBLY HAVING A BREATH GUARD

(71) Applicant: KIMPEX INC., Drummondville (CA)

(72) Inventors: Jean-Simon Levesque, Victoriaville (CA); Nicolas Bouchard Fortin, Racine (CA); Stephane Dion, Granby (CA); Étienne Gilbert, Beloeil (CA)

(73) Assignee: KIMPEX INC., Drummondville (CA)

( * ) Notice: Subject to any disclaimer, the term of this patent is extended or adjusted under 35 U.S.C. 154(b) by 106 days.

(21) Appl. No.: 16/797,731

(22) Filed: Feb. 21, 2020

(65) Prior Publication Data

US 2020/0268090 A1 Aug. 27, 2020

Related U.S. Application Data

(60) Provisional application No. 62/809,189, filed on Feb. 22, 2019.

(51) Int. Cl.
*A42B 3/22* (2006.01)
*A42B 3/24* (2006.01)

(52) U.S. Cl.
CPC ..... *A42B 3/222* (2013.01); *A42B 3/227* (2013.01); *A42B 3/24* (2013.01)

(58) Field of Classification Search
CPC ..... A42B 3/222; A42B 3/227; A42B 3/24; A42B 3/223; A41D 13/1161; A41D 13/1169
See application file for complete search history.

(56) References Cited

U.S. PATENT DOCUMENTS

| | | | | |
|---|---|---|---|---|
| 5,758,639 | A | 6/1998 | Ikonen | |
| 7,836,887 | B1 * | 11/2010 | Kling | A41D 13/1161 128/206.16 |
| 8,407,819 | B2 | 4/2013 | Chen | |
| 8,707,471 | B2 | 4/2014 | Chen | |
| 2015/0196080 | A1 | 7/2015 | Handfield et al. | |
| 2017/0367432 | A1 * | 12/2017 | Handfield | A42B 3/326 |

FOREIGN PATENT DOCUMENTS

| | | | |
|---|---|---|---|
| JP | 10-110321 | A | 4/1998 |

* cited by examiner

*Primary Examiner* — Khoa D Huynh
*Assistant Examiner* — Erick I Lopez
(74) *Attorney, Agent, or Firm* — Myers Bigel, P.A.

(57) ABSTRACT

A helmet including a visor assembly having a breath guard is provided. The visor assembly includes a visor pivotally connected to the helmet shell and having an inner surface facing the cavity when in the lowered position. The visor assembly further includes a breath guard interface provided below the visor and a breath guard which has a visor interface connected to the breath guard interface of the visor assembly. The breath guard includes a flexible member connected to and extending from the visor interface and a contact surface shaped and configured to engage the wearer's face around the nose and mouth for deflecting humid air away from the inner surface of the visor. The flexible member has a channel extending along the visor interface having a substantially V-shaped cross-section configured to allow the flexible member to be deformed when raising the visor.

26 Claims, 10 Drawing Sheets

HELMET ASSEMBLY WITH VISOR ASSEMBLY HAVING A BREATH GUARD

CROSS-REFERENCE TO RELATED APPLICATIONS

This application claims priority under 35 USC § 119(e) of US Provisional Application No. 62/809,189, filed Feb. 22, 2019, entitled "HELMET ASSEMBLY WITH VISOR ASSEMBLY HAVING A BREATH GUARD", the entirety of which is hereby incorporated by reference.

TECHNICAL FIELD

The technical field generally relates to helmets, and more particularly to helmets provided with breathguards, and to breathguard assemblies.

BACKGROUND

Helmets used for outdoor activities typically include a shell that defines a cavity for housing a wearer's head, and a front opening to allow the wearer to see. For helmets used for winter activities, such as snowmobiling, the front opening can be covered by goggles, or by a visor that is pivotally mounted to the helmet shell, to protect the eyes of the wearer when riding. Additionally, these helmets can include a breath guard (or breath deflector) that creates a barrier between the wearer's nose and mouth and the visor, for preventing, or at least limiting, fog from accumulating on the inner surface of the visor. For some helmets, the breath guard is connected on the inner side of the helmet shell, and raising the visor and/or lower section of the helmet (e.g., by lifting the chin guard of the helmet) disengages the breath guard from the wearer's face.

When raising the visor and/or chin guard, the breath guard is also raised and positioned above the front opening. In some cases, the breath guard contacts the top surface of the helmet shell, above the front opening, which can unduly deform the breath guard, apply stress to the breath guard and/or prevent raising the visor to its uppermost position. Overtime, the breath guard can become worn down/damaged, which in turn may reduce isolation of the wearer's nose and mouth from the visor.

There is therefore a need for a helmet, or helmet assembly, that can overcome at least some of the drawbacks of what is known in the field.

SUMMARY

According to a first aspect, a helmet is provided. The helmet includes a helmet shell defining a cavity for receiving a wearer's head, the helmet shell further having a front opening. The helmet also includes a visor assembly comprising a visor pivotally connected to the helmet shell and being movable between a lowered position for substantially covering the front opening, and a raised position. The visor has an inner surface facing the cavity when in the lowered position, and when in the raised position, a gap is defined between the visor and a top surface of the helmet shell. The visor assembly further includes a breath guard interface provided below the visor or proximate a lower portion thereof and a breath guard having a visor interface connected to the breath guard interface of the visor assembly. The breath guard includes a flexible member having a front portion extending from the visor interface and a rear portion extending rearwardly from the front portion. The rear portion has a contact surface shaped and configured to engage the wearer's face around the nose and/or mouth for deflecting humid air away from the inner surface of the visor when the visor is in the lowered position. The front portion of the flexible member defines a channel extending along the visor interface, the channel having a substantially V-shaped cross-section configured to allow the flexible member to be deformed when the visor is raised, thereby allowing the breath guard to at least partially fit within the gap between the visor and top surface of the helmet shell.

According to a possible embodiment, the breath guard is operable between a first configuration where the flexible member extends at least partially above the visor interface, and a second configuration where the flexible member extends below the visor interface when moving the visor in the raised position.

According to a possible embodiment, the flexible member includes a nose cover for covering the wearer's nose, and a pair of wings extending on opposed sides of the nose cover, and wherein the contact surface of the flexible member extends along a rear edge of the nose cover and the pair of wings, and is adapted to contact the wearer's face around the nose and along the cheeks.

According to a possible embodiment, the channel has a first sidewall being substantially parallel and connected to the visor interface and a second sidewall extending upwardly from a bottom portion of the first sidewall, thereby defining the V-shaped cross-section.

According to a possible embodiment, the channel extends along the visor interface between the visor interface and the nose cover and the pair of wings.

According to a possible embodiment, when the breath guard is in the first configuration, the nose cover extends above the visor interface by a first distance, and when the breath guard is in the second configuration, the nose cover extends below the visor interface by a second distance, the second distance being greater than the first distance.

According to a possible embodiment, the second distance is about twice the first distance.

According to a possible embodiment, the first sidewall has a height extending between a top edge and the bottom edge thereof, and wherein the height of the first sidewall is greater proximate the nose cover and gradually decreases along the pair of wings.

According to a possible embodiment, the channel has a bottom edge extending at least partially below the nose cover and pair of wings.

According to a possible embodiment, the nose cover and pair of wings include a top surface extending between the second sidewall of the channel and the contact surface, and further include a bottom surface spaced from and overlapping the top surface, the bottom surface being connected to the top surface via the contact surface.

According to a possible embodiment, the breath guard includes an adjustment mechanism operable for adjusting the flexible member to conform to the wearer's face and isolate the wearer's nose and/or mouth from the internal surface of the visor.

According to a possible embodiment, the adjustment mechanism includes a strap assembly having a pair of straps respectively connecting one of the wings of the flexible member to the visor interface, such that operating the strap assembly adjusts a length of the straps for tightening or loosening the flexible member onto the wearer's face.

According to a possible embodiment, each wing of the flexible member includes a strap aperture extending through the top surface for connecting a first end of the corresponding strap thereto, and wherein the visor interface has a pair of strap receiving slots for respectively connecting a second end of the corresponding strap thereto.

According to a possible embodiment, the visor interface is substantially rigid and arcuate to at least partially conform to the shape of the visor and/or helmet shell.

According to a possible embodiment, the visor interface is removably connectable to the breath guard interface.

According to a possible embodiment, the visor interface includes a visor interface member which connects to the breath guard interface from below.

According to a possible embodiment, each wing of the flexible member includes a sealing protrusion extending outwardly therefrom for engaging the visor assembly and creating a seal therebetween to prevent humid air from contacting the inner surface of the visor.

According to a possible embodiment, the sealing protrusions extend from the wings at opposite ends of the contact surface.

According to a possible embodiment, the flexible member is made of at least one elastomeric material adapted to allow the flexible member to revert back to its initial shape when the visor is lowered from the raised position or when the strap assembly is loosened.

According to a possible embodiment, the flexible member is made of a thermoplastic elastomer.

According to a possible embodiment, the flexible member and visor interface are integrally moulded together.

According to a second aspect, a breath guard connectable to a visor assembly of a helmet for deflecting humid air away from an inner surface of a visor is provided. The breath guard includes a visor interface operatively connected to the visor assembly, and a flexible member having a front portion connected to and extending from the visor interface and a rear portion extending rearwardly from the front portion. The rear portion has a contact surface shaped and configured to engage the wearer's face around the nose and/or mouth for deflecting humid air away from the inner surface of the visor when the visor is in the lowered position. The front portion of the flexible member defines a channel extending along the visor interface, the channel having a substantially V-shaped cross-section configured to allow the flexible member to be deformed when raising the visor, thereby allowing the breath guard to fit within a gap defined between the visor and the helmet.

According to a third aspect, a visor assembly of a helmet having a helmet shell defining a cavity is provided. The visor assembly includes a visor pivotally connected to the helmet shell movable between a lowered position for substantially covering the front opening, and a raised position thereby defining a gap between the visor and the helmet shell. The visor has an inner surface facing the cavity when in the lowered position. The visor assembly further includes a breath guard interface provided below the visor and a breath guard. The breath guard includes a visor interface connected to the breath guard interface of the visor assembly; and a flexible member having a front portion connected to and extending from the visor interface and a rear portion extending rearwardly from the front portion. The rear portion has a contact surface shaped and configured to engage the wearer's face around the nose and/or mouth for deflecting humid air away from the inner surface of the visor when the visor is in the lowered position. The front portion of the flexible member defines a channel extending along the visor interface, the channel having a substantially V-shaped cross-section configured to allow the flexible member to be deformed when raising the visor, thereby allowing the breath guard to fit within the gap between the visor and helmet shell.

According to yet another aspect, a breath guard connectable to a visor assembly of a helmet for deflecting humid air away from an inner surface of a visor is provided. The breath guard includes a visor interface operatively connected to the visor assembly, and a flexible member having a front portion extending from the visor interface and a rear portion extending rearwardly from the front portion. The rear portion having a contact surface shaped and configured to engage the wearer's face around the nose and mouth for deflecting humid air away from the inner surface of the visor when the visor is in the lowered position. The breath guard further includes an adjustment mechanism operable for adjusting the flexible member to conform to the wearer's face and isolate the wearer's nose and/or mouth from the internal surface of the visor.

According to another aspect, a helmet is provided. The helmet includes a helmet shell defining a cavity for receiving a wearer's head and having a front opening. The helmet also includes a visor assembly having a visor pivotally connected to the helmet shell and being movable between a lowered position for covering the front opening, and a raised position. The visor has an inner surface facing the cavity when in the lowered position, and when in the raised position, a gap is defined between the visor and a top surface of the helmet shell. The visor assembly also includes a breath guard interface provided below the visor or proximate a lower portion thereof; and a breath guard. The breathguard includes a visor interface connectable to the breath guard interface of the visor assembly; and a flexible member having a nose cover shaped and sized for covering the wearer's nose, and a pair of wings extending on opposed sides of the nose cover. The flexible member further has a front portion extending from the visor interface and a rear portion extending rearwardly from the front portion, the rear portion having a contact surface shaped and configured to engage the wearer's face around the nose and/or mouth for deflecting humid air away from the inner surface of the visor when the visor is in the lowered position, the front portion being provided with a channel extending along the visor interface, the channel having a substantially V-shaped cross-section configured to allow the flexible member to be deformed and have the breath guard at least partially fit within the gap defined between the visor and top surface of the helmet shell when the visor is raised.

DETAILED DESCRIPTION

In the following description, the same numerical references refer to similar elements. In addition, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only.

Furthermore, although the various exemplary embodiments described herein may be used in relation with a snowmobile helmet, for example, it is understood that it may be used with other types of helmets and/or for other purposes. For this reason, the term "helmet" as used herein should not be taken as to limit the scope of the present disclosure as being restricted to snowmobile helmets. It should be understood that the term "helmet" should, in the context of the present disclosure, encompass all other types of helmets for which the breath guard assembly may be useful.

In addition, although the optional configurations as illustrated in the accompanying drawings comprise various components and although the optional configurations of the helmet and helmet accessories as shown may consist of certain configurations as explained and illustrated herein, not all of these components and configurations are essential and thus should not be taken in their restrictive sense, i.e. should not be taken as to limit the scope of the present disclosure. It is to be understood that other suitable components and cooperation thereinbetween, as well as other suitable configurations may be used for the helmet, and corresponding parts, as briefly explained, and as can be easily inferred therefrom, without departing from the scope of the disclosure.

As will be explained below in relation to various embodiments, a helmet is described, wherein the helmet includes a visor assembly and a breath guard. The breath guard is connected to the visor assembly such that when the visor is lowered, the breath guard engages the wearer's face around the nose and/or mouth for deflecting humid air away from the visor. The breath guard can be moved away from the wearer's face by raising the visor, therefore positioning the breath guard above the front opening of the helmet. The breath guard is thus placed, at least partially, within a gap defined between the visor and top surface of the shell. As will be described further below, the breath guard is shaped and configured to be deformed as the visor is raised, in order to prevent/reduce damage caused to the breath guard due to contact of the breath guard with the helmet shell, for example, and to facilitate disengagement of the visor from the helmet's front opening when raising the visor.

Figure 1:
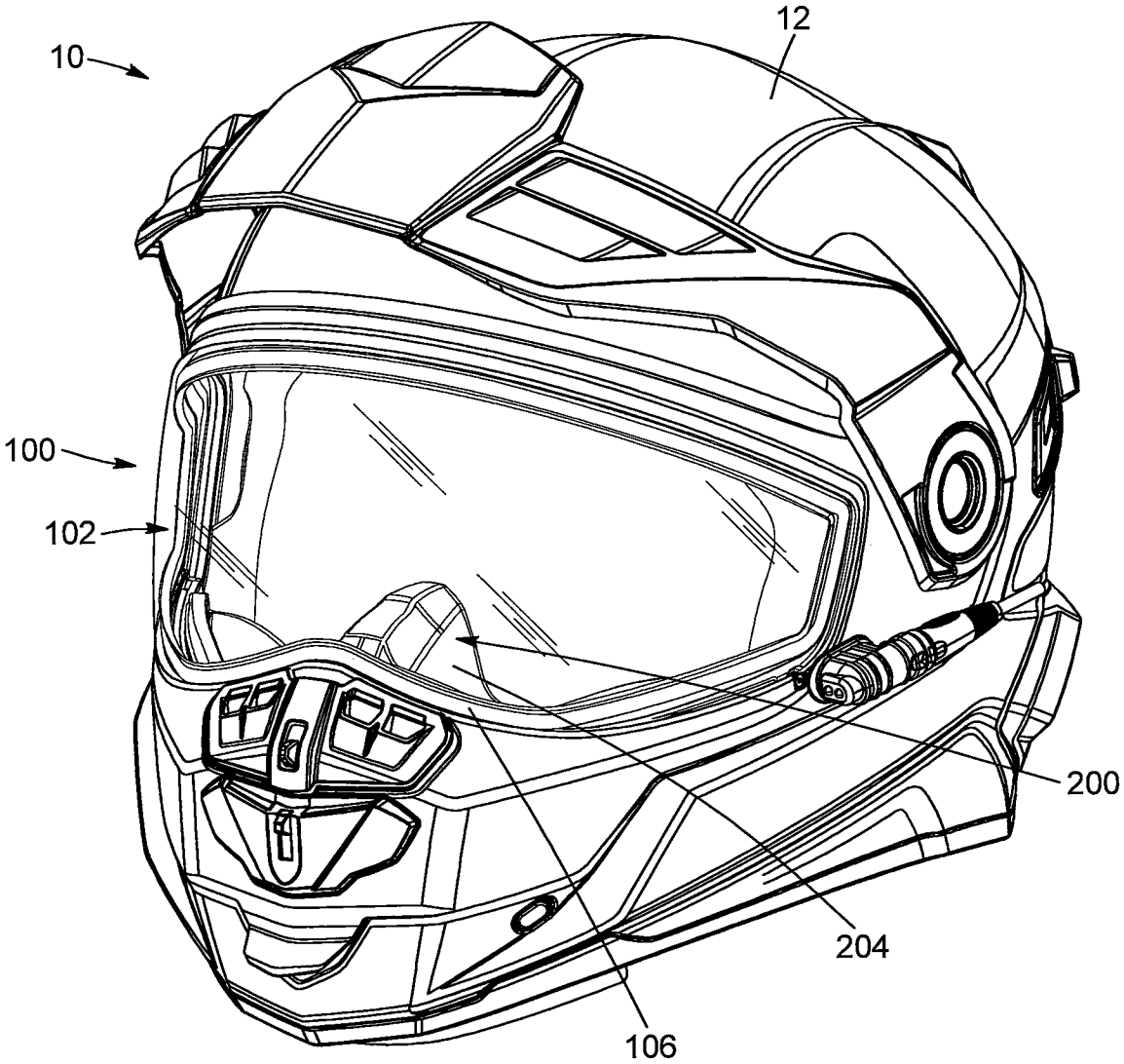
FIG. 1 is a perspective view of a helmet according to an embodiment, showing a breath guard engaging the wearer's face.
Figure 2:
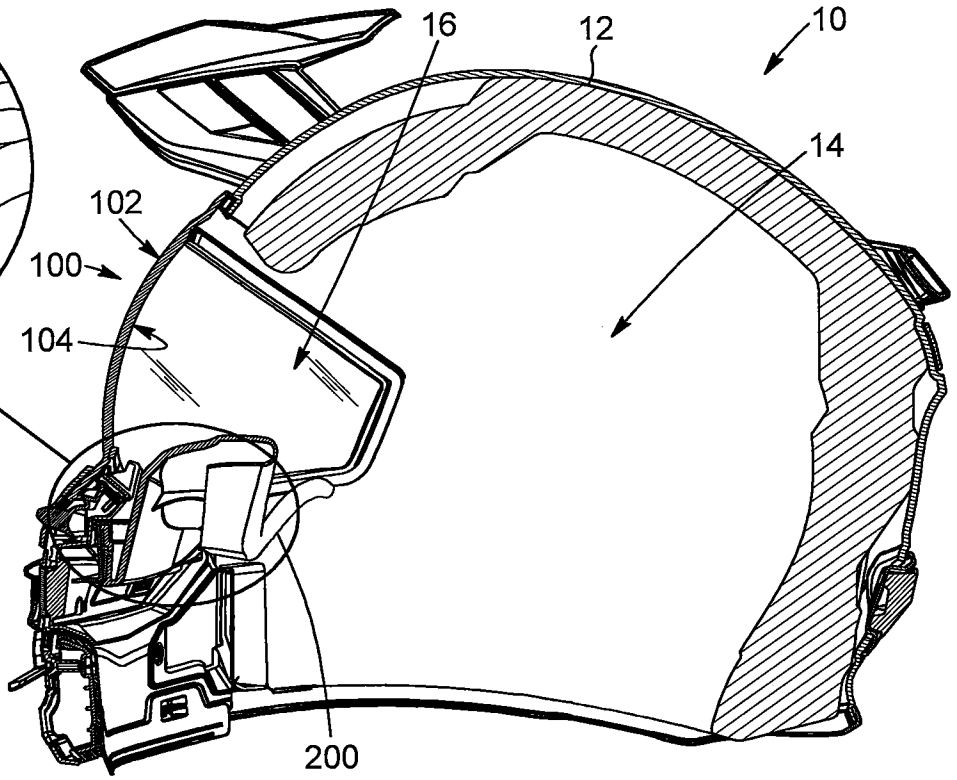
FIG. 2 is a side elevation sectional view of a helmet, showing a breath guard connected to a visor assembly, according to an embodiment.
Figure 3:
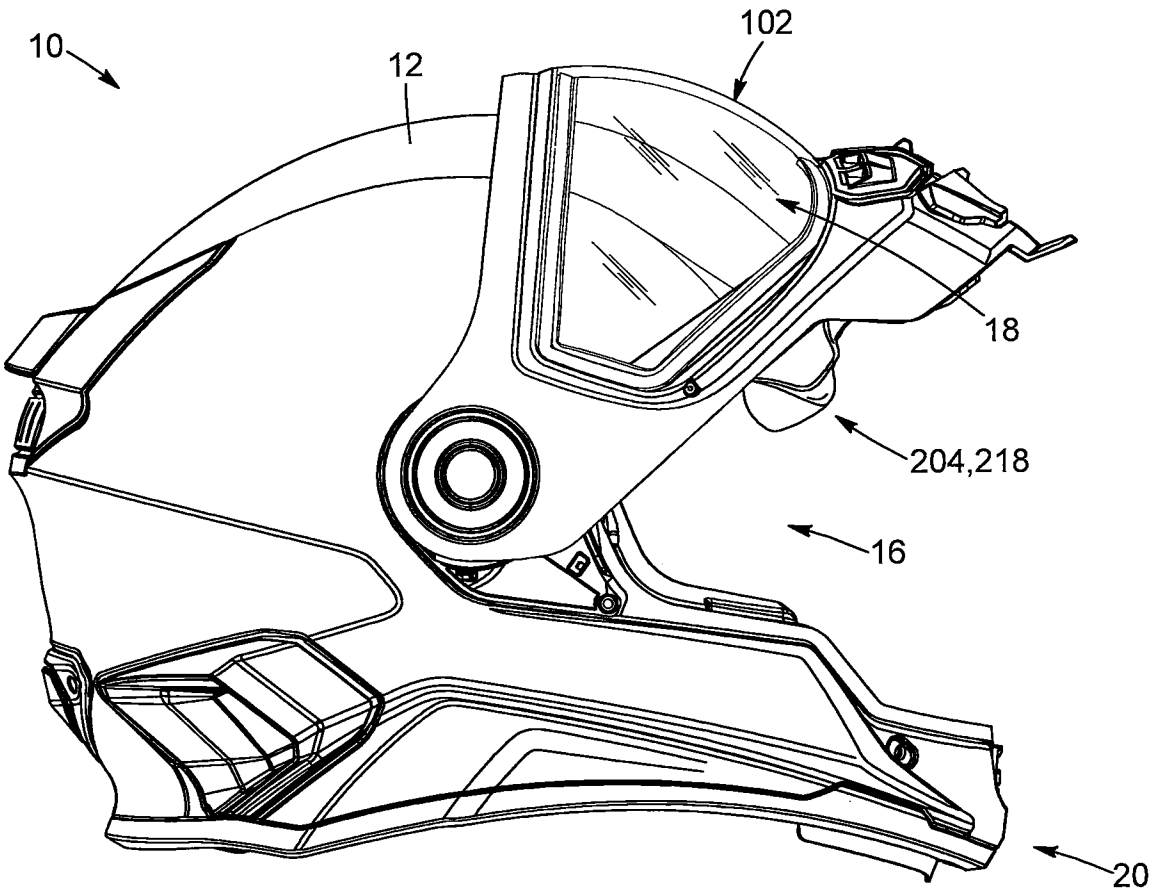
FIG. 3 is a side elevation view of a helmet according to an embodiment, showing a visor in a raised position.

Referring to FIGS. 1 through 3, a helmet 10 is shown in accordance with a possible embodiment. In this embodiment, the helmet 10 includes a protective helmet shell 12 defining a cavity 14 shaped and configured to receive a wearer's head. The helmet shell 12 further has a front opening 16 communicating with the cavity 14 in order to allow the wearer to see. In this embodiment, the helmet 10 has a visor assembly 100 which includes a visor 102 pivotally connected to the helmet shell 12 for covering the front opening 16. The visor 102 can be operable (i.e., movable) between a lowered position (FIG. 1), where the visor 102 covers and substantially seals the front opening 16, and a raised position (FIG. 3). It is appreciated that, when in the raised position, the visor 102 is effectively raised and positioned on top of the helmet shell 12. A gap 18 is thus defined or created between the inner face of the visor 102, and the top surface of the helmet shell 12. When the visor 102 is lowered, it is appreciated that its inner surface 104 faces and substantially closes the cavity 14.

In the illustrated embodiment, the helmet 10 is a full-face type helmet, where the chin guard 20 forms part of the helmet shell 12 (i.e., the chin guard is static). Having a static chin guard 20 can advantageously reduce the weight of the helmet 10 since the chin guard 20 does not require a pivoting/rotating mechanism (e.g., a hinge) to pivotally connect the chin guard 20 to the helmet shell 12. By reducing the weight of the helmet 10, the stress applied to the wearer's head and neck can accordingly be reduced, thus increasing overall comfort when wearing the helmet 10. However, it is appreciated that the visor assembly and breath guard described herein can be used with other types of helmets than full-face type helmets, such as bowl-type helmets, in which the chin guard is a movable chin guard (i.e., the chin guard can be raised along with the visor to reveal/open the front opening 16), for example.

In this embodiment, the visor assembly 100 includes a breath guard 200 connectable to the visor 102 such that moving the visor 102 also moves the breath guard 200. More specifically, in the illustrated embodiment, the visor assembly 100 includes a breath guard interface 106 positioned below the visor 102. The breath guard interface 106 can be part of the visor or be formed as a distinct element. The breath guard interface 106 is preferably provided at or near the bottom edge of the visor 102. The breath guard 200 also includes a connecting interface, namely a visor interface 202, configured to cooperate with or be connected or mated to the breath guard interface 106. The breath guard and visor interfaces 106, 202 are preferably provided with complementary shapes, so as to facilitate connection therebetween. However, it is appreciated that the breath guard and/or visor interfaces 106, 202 can have other suitable shape(s) allowing connection therebetween. The breath guard interface 106 and the visor interface 202 can be integrally formed in the visor 102 and breath guard 200 respectively, or can consist of separate connectors and/or interface members, attachable or connectable to the visor and breath guard. In the illustrated embodiment, the breath guard interface 106 is a member distinct from the visor 102, and connectable thereto. However, the visor interface 202 of the breath guard 200 forms part of, and is integral to, the breath guard.

Figure 2A:
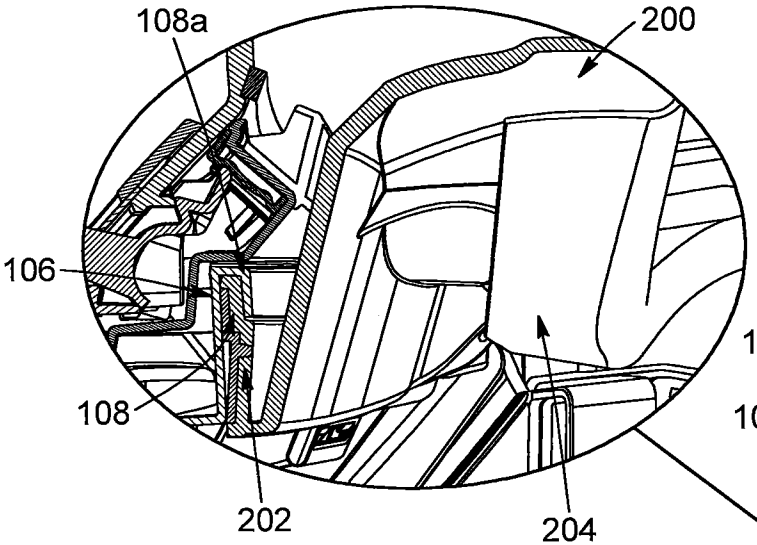
FIG. 2A is an enlarged view of the section shown in FIG. 2.

Referring more specifically to FIGS. 2 and 2A, the breath guard and visor interfaces 106, 202 can be made of a substantially rigid material (e.g., plastic), although it is appreciated that other materials, or types of materials, can be used. In some embodiments, the breath guard and visor interfaces 106, 202 are arcuate, so at to conform, at least partially, to the shape of the visor 102 and/or helmet shell 12 proximate the visor 102. In this embodiment, the interfaces 106, 202 are removably connected to one another to allow the breath guard 200 to be removed when desired (e.g., to eat or drink) or for cleaning, repairing or replacing the breath guard, for example.

As shown in FIG. 2A, the breath guard interface 106 can have a breath guard receiving slot 108 defined therealong and shaped to receive a portion of the visor interface 202 of the breath guard 200. In this embodiment, the breath guard interface 106 has a hook-like edge 108*a* defining the breath guard receiving slot 108. The hook-like edge 108*a* is shaped such that the visor interface 202 extends within the breath guard receiving slot 108 from below, although it is appreciated that other configurations are possible. In some embodiments, the visor interface 202 connects to the breath guard interface 106 via a snap-fit connection as it extends within the breath guard receiving slot 108. For example, the visor interface 202 can have a forwardly projecting top edge 203 (FIG. 6A) adapted to extend within a complementary-shaped portion of the breath guard receiving slot 108 in order to connect the breath guard 200 to the breath guard interface 106. Alternatively, it is appreciated that the interfaces 106, 202 can be connected to one another using any other suitable means, such as an adhesive or mechanical fasteners, for example.

Figure 9:
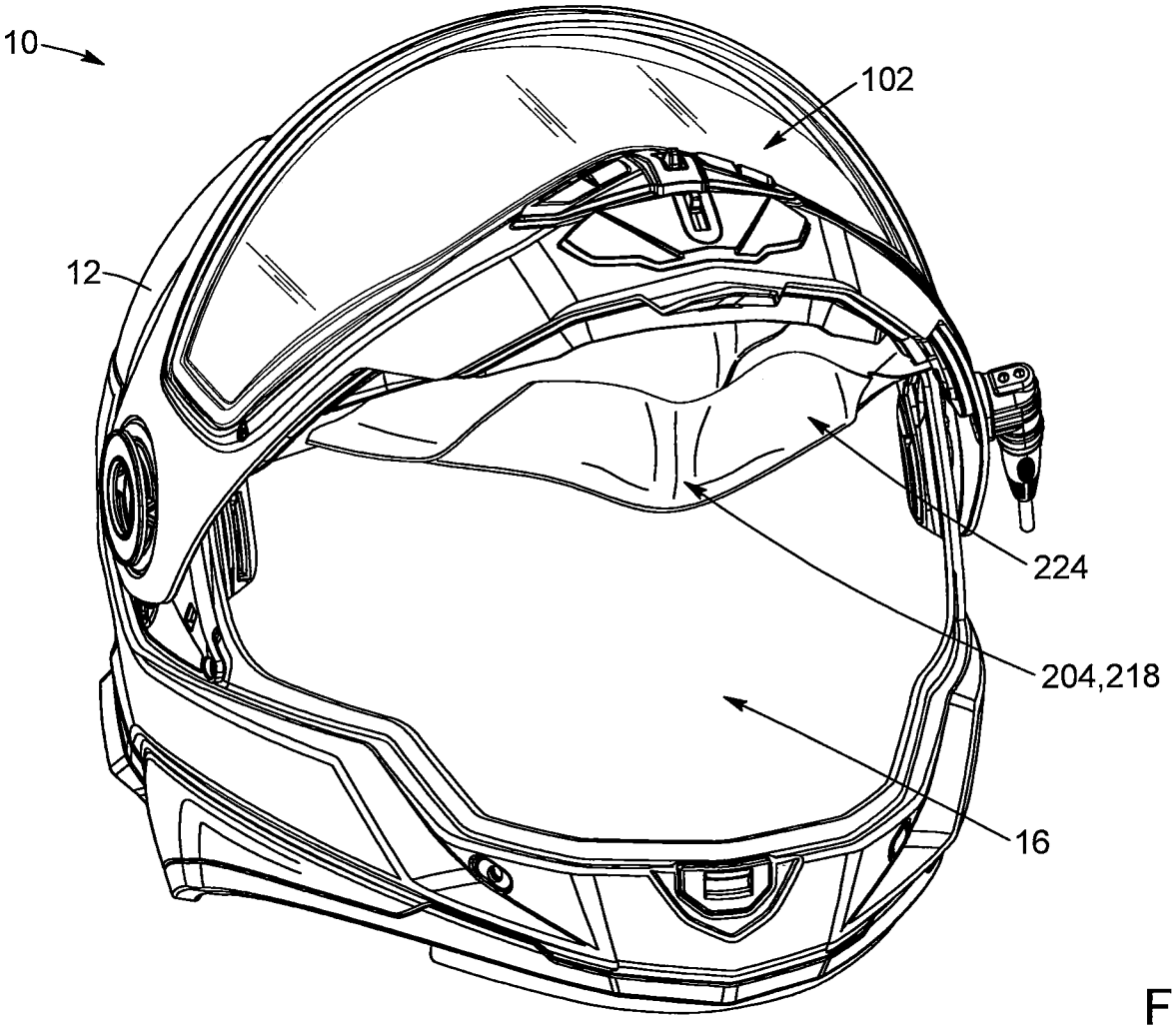
FIGS. 9 and 10 are perspective views of the helmet shown in FIG. 3, showing a flexible member of the breath guard being deformed when the visor is raised.
Figure 10:
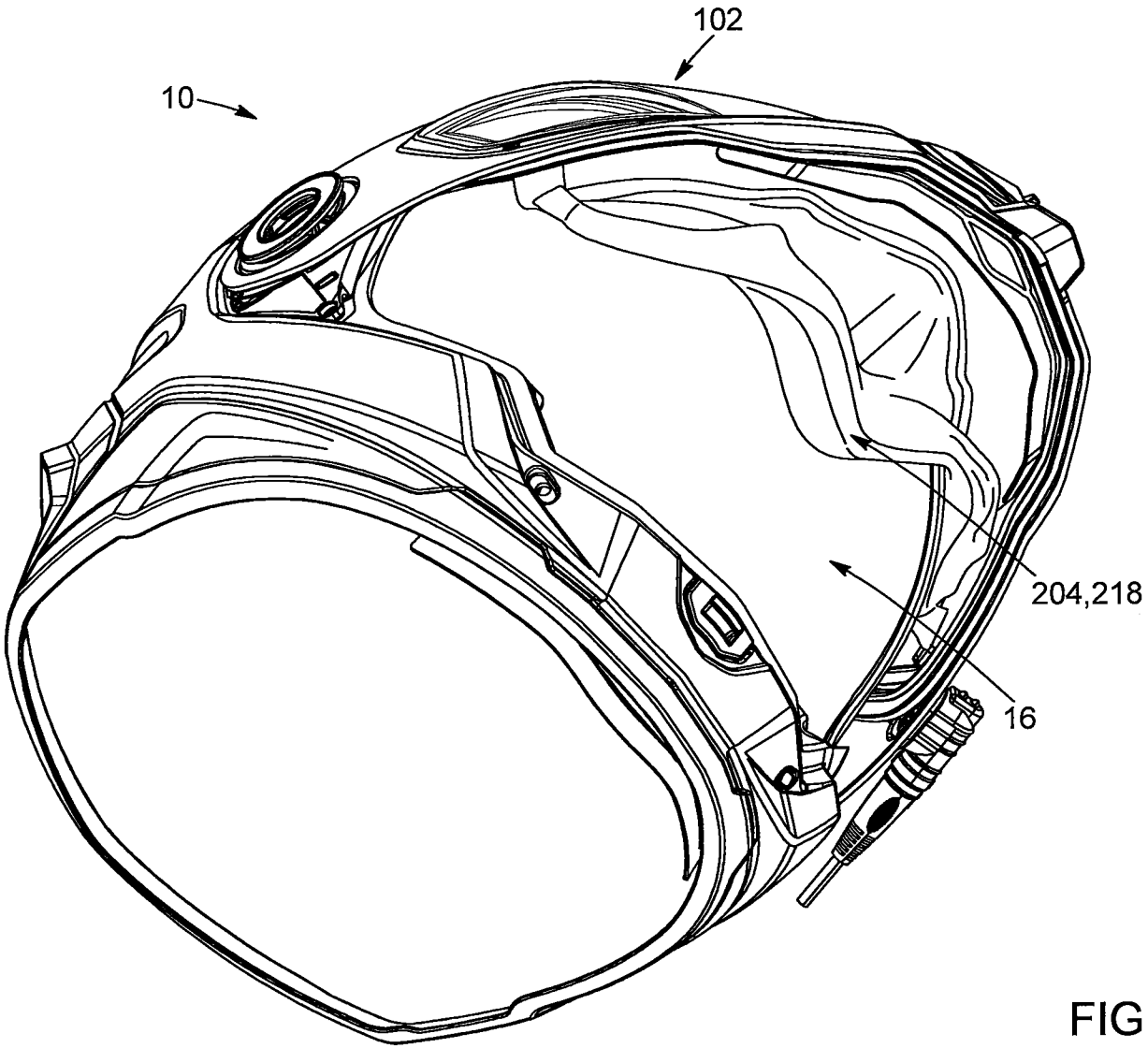

Referring to FIGS. 4 to 7A, a possible embodiment of the breath guard 200 is shown. In this embodiment, the breath guard 200 includes a flexible member 204 connected to and extending from the visor interface 202 for engaging the face of the wearer. As shown in FIG. 1, when the visor 102 is in the lowered position, the flexible member 204 is adapted to engage the wearer's face around the nose and/or above the mouth for deflecting humid air away from the inner surface of the visor, thereby preventing fog from accumulating thereon. In other words, the flexible member 204 can be shaped and configured in any suitable manner to seal, or at least partially isolate the wearer's nose and/or mouth from the inner surface of the visor. In this embodiment, raising the visor 102 effectively positions the breath guard above the front opening, along with the visor 102 (as best shown in FIGS. 3, 9 and 10).

Still referring to FIGS. 4 to 7A, the flexible member 204 has a front portion 206 connected to and extending from the visor interface 202, and a rear portion 208 extending from the front portion 206 towards the face of the wearer (i.e., when the helmet is in use). The "front portion" is located farther away from the wearer's face, when the helmet is worn, while the "rear portion" is located closer to the wearer's face. In other words, the "front portion" of the flexible member is located closer to the visor, while the "rear portion" is closer to the wearer's face, and extends towards the cavity of the helmet.

The rear portion 208 preferably has a contact surface 210 shaped and configured to engage the wearer's face around the nose and/or mouth for deflecting humid air (e.g., air being breathed by the wearer) away from the inner surface of the visor 104. In other words, the flexible member 204 can be adapted to define a top portion and a bottom portion within the helmet. In this embodiment, the top portion includes the visor 102 and is thus the area in which the wearer's eyes are situated. The bottom portion includes the chin guard and is where the wearer's nose and mouth are situated. The flexible member 204 can be configured to at least partially isolate the top portion from the bottom portion so as to prevent fog accumulation on the inner surface of the visor, for example.

In some embodiments, the front portion 206 of the flexible member 204 is shaped in a manner to define a channel 212 (or recess, gutter or furrow) extending at least partially along the visor interface 202. The channel 212 is shaped and configured to increase the flexibility, stretchability and capacity of deforming the flexible member 204, as will be described further below. In the illustrated embodiment, the channel 212 has a substantially V-shaped cross-section, although it is appreciated that the shape of the channel can be different. For example, a U-shaped channel can be considered, or the channel could be formed as a furrow, a recess, or with several folds and creases formed within the breath guard flexible material, among other possibilities.

In this embodiment, the flexible member 204 includes a nose cover 218 shaped and sized to cover the wearer's nose, and a pair of wings 220 extending on either side of the nose cover 218. The nose cover 218 has a substantially inverted U-shape in order to cover the wearer's nose. The contact surface 210 is preferably defined along a rear edge of the nose cover 218 and wings 220, and is adapted to contact/engage the wearer's face around the nose, via the nose cover 218, and along the cheeks, via each wing of the pair of wings 220.

In this embodiment, the nose cover 218 is shaped and sized to contact the helmet shell 12 (e.g., proximate a top edge of the front opening 16) when the visor 102 is raised. Advantageously, the flexible member 204 is shaped and configured to deform and stretch as the visor 102 is raised, thereby facilitating movement of the visor 102 (e.g., raising and/or lowering). More specifically, the channel 212 formed along the visor interface 202 allows the flexible member 204 to be deformed and stretched, such that a greater portion of the breath guard can fit within the gap between the top surface of the helmet and the raised visor, allowing the visor to be raised farther away relative to the helmet's front opening (as seen in FIG. 3). It is appreciated that being able to fully raise the visor can increase the wearer's field of vision through the front opening of the helmet shell 12, among other advantages.

Figure 7:
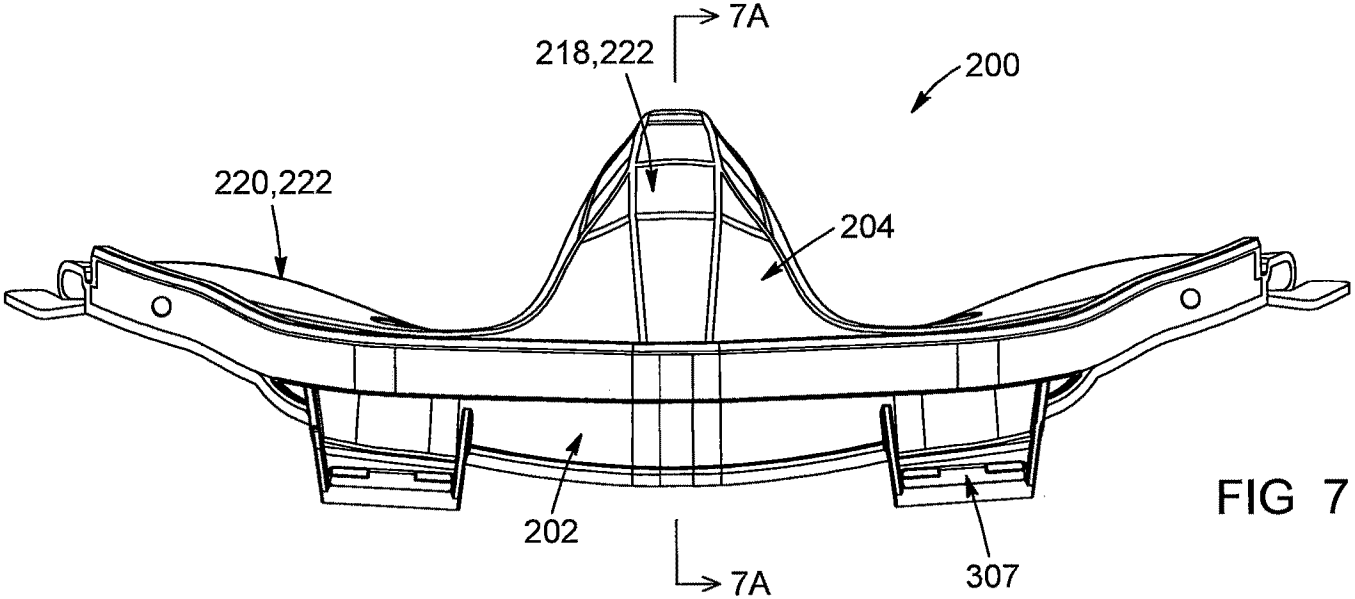
FIG. 7 is a front elevation view of the breath guard shown in FIG. 4.
Figure 7A:
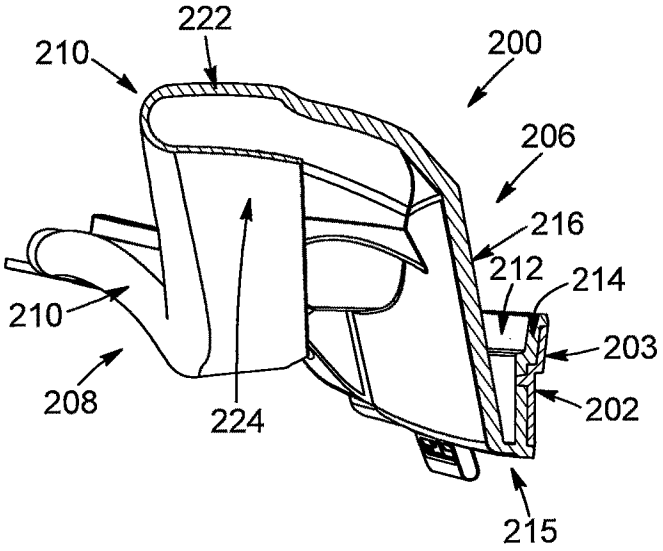
FIG. 7A is a sectional view taken along cross-section line A-A in FIG. 7, showing a channel having a V-shaped cross-section proximate the front of the breath guard.

Referring more specifically to FIGS. 7 and 7A, the channel 212 can have a first sidewall 214 and a second sidewall 216 connected to one another. In the illustrated embodiment, the second sidewall 216 extends upwardly from the bottom edge of the first side wall 214 thereby defining the V-shaped cross-section of the channel 212. As best seen in FIG. 7A, the first sidewall 214 is substantially parallel, and connected, to the visor interface 202. As such, it is appreciated that the first sidewall 214 is adapted to be inserted within the breath guard receiving slot 108 (seen in FIG. 2A) of the breath guard interface 106, along with the visor interface 202. The first sidewall 214 can be connected to the visor interface 202 using any suitable means, such as an adhesive, mechanical fasteners, or via a snap-fit connection, for example. Alternatively, as in the illustrated embodiment, the first sidewall 214 and visor interface 202 can be integrally moulded as a one-piece unit.

As seen in FIG. 7A, the second sidewall 216 extends rearwardly from a bottom portion 215 of the first sidewall 214 towards the rear portion 208 (e.g., towards the cavity of the helmet). More particularly, the second sidewall 216 connects with the nose cover 218 and the wings 220 such that the channel 212 is defined along the visor interface 202 between the visor interface 202 and the nose cover 218 and wings 220. In some embodiments, the first sidewall 214 has a height defined between a top edge and bottom edge thereof. The height of the first sidewall 214 can correspond to the depth of the channel 212, and can vary along the visor interface 202. For example, the height of the first sidewall can be greater proximate the nose cover 218 and can gradually decrease along the pair of wings. It should thus be understood that the depth of the channel 212 correspondingly decreases from the nose cover 218 along the wings 220. In some embodiments, the channel 212 extends along an entire length of the visor interface 202 (i.e., from the center of the nose cover 218 to each end of the wings 220), although it is appreciated that the channel 212 can alternatively extend along a portion of the visor interface 202. Additionally, as shown in FIG. 7A, the channel 212 is shaped and sized such that the bottom of the channel 212 (i.e., the lowest point thereof) is positioned at least partially below the other components of the breath guard 200 (e.g., nose cover 218 or wings 220). This configuration of the channel 212 advantageously provides improved flexibility/deformability to the flexible member 204 (e.g., increases the range of motion of the nose cover 218 when the visor is raised).

Referring to FIGS. 7 and 7A, the nose cover 218 and wings 220 can include a top surface 222 extending between the contact surface 210 and the second sidewall 216 of the channel 212. Furthermore, the nose cover 218 and wings 220 can also include a bottom surface 224 spaced from the top surface 222 such that the top and bottom surfaces overlap one another. As seen in FIG. 7A, the bottom surface 224 is connected to the top surface 222 via the contact surface 210. In some embodiments, the top, bottom and contact surfaces are a single continuous surface bent into the desired shape (e.g., with the top and bottom surfaces overlapping each other). However, it is appreciated that other configurations are possible.

Figure 4:
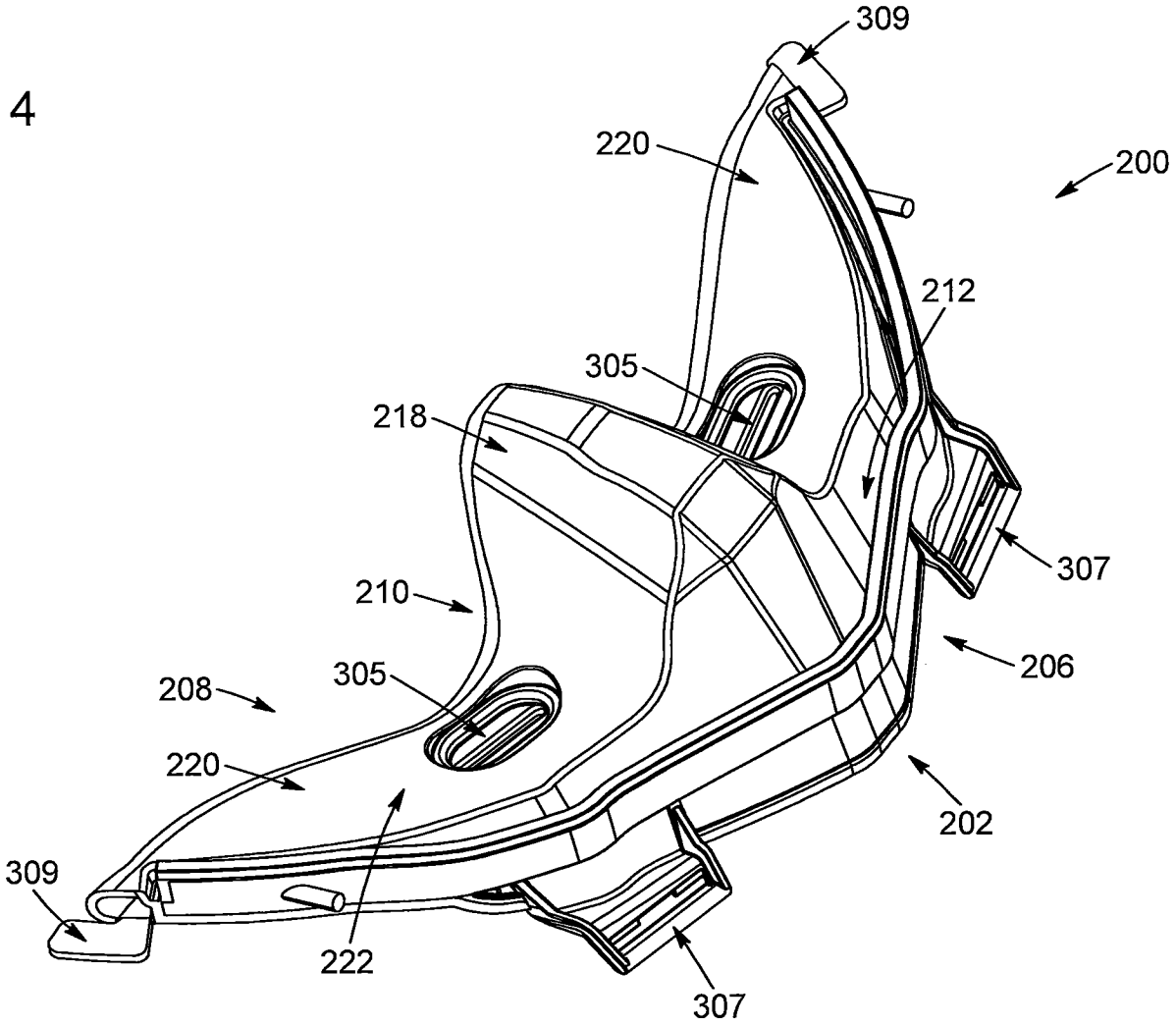
FIG. 4 is a perspective view of a breath guard according to an embodiment, showing a nose cover and wings extending therefrom.
Figure 5:
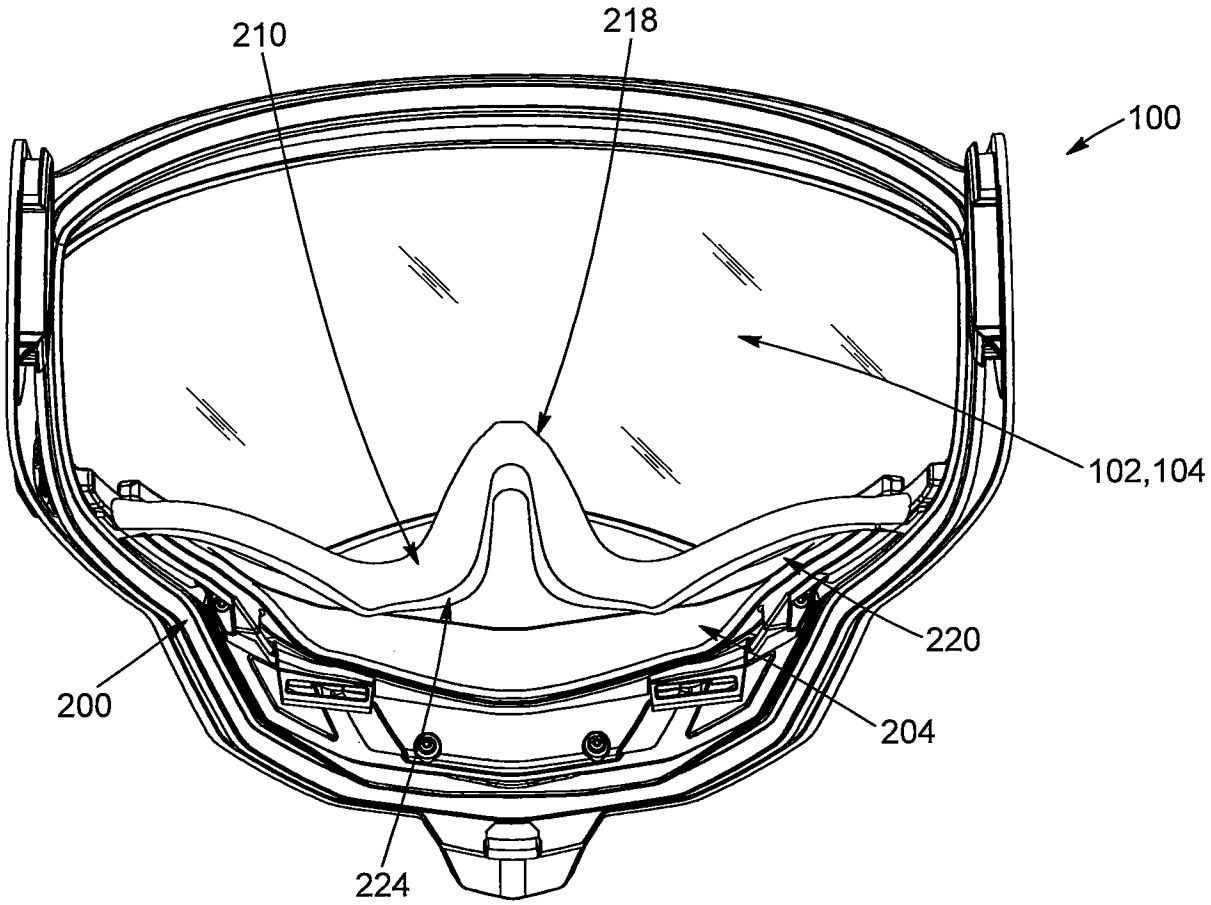
FIG. 5 is a rear elevation view of a breath guard according to an embodiment, showing the nose cover extending upwardly.
Figure 6:
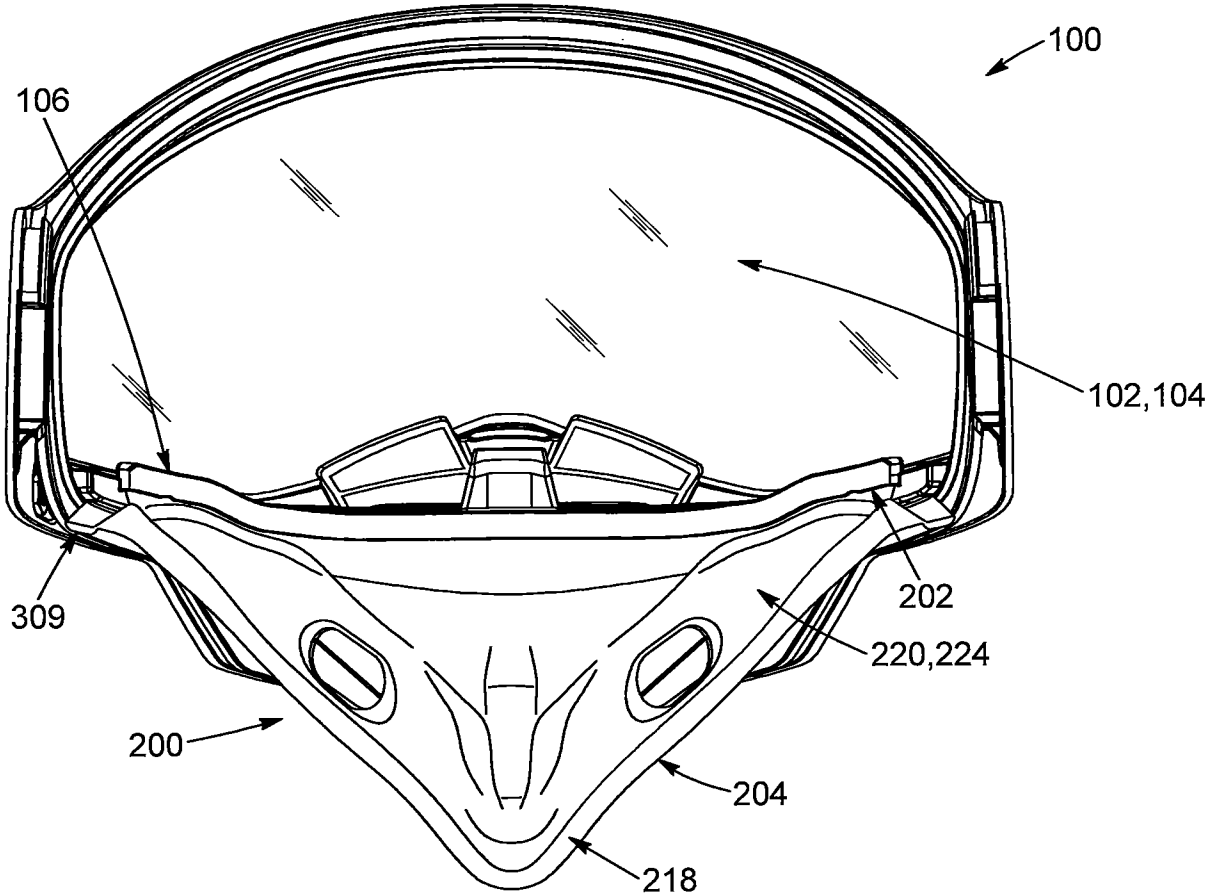
FIG. 6 is a rear elevation view of the breath guard shown in FIG. 5, showing the nose cover deformed and extending downwardly.

Referring broadly to FIGS. 1 through 10, it should be noted that the breath guard 200 can be operable between a first configuration, where the flexible member 204 extends at least partially above the visor interface 202, as seen in FIGS. 4 and 5, and a second configuration, where the flexible member 204 is deformed and extends below the visor interface 202, as seen in FIGS. 6 and 9. More specifically, in the first configuration of the breath guard 200, the nose cover 218 extends at least partially above the visor interface 202. In the second configuration, the flexible member 204 is deformed in a manner such that the nose cover 218 extends below the visor interface 202. It should thus be understood that operating the breath guard 200 between the first and second configurations corresponds to deforming the flexible member 204 via movement of the visor 102 (e.g., raising the visor). The second configuration of the breath guard is further illustrated in Figures Sand 10, where the visor 102 is positioned in the raised position thereby deforming the flexible member 204.

In some embodiments, raising the visor 102 above the front opening effectively positions the breath guard interface 106 within the gap 18 defined between the visor 102 and the helmet shell 12. As such, the visor interface 202, which is connected to the breath guard interface 106, is also positioned within the gap 18, along with at least a portion of the flexible member 204. In some embodiments, the flexible member 204 can be made of a resilient and/or elastomeric material, such as a thermoplastic elastomer (e.g., rubber) adapted to be deformed and subsequently revert to its initial shape/position. As mentioned above, the nose cover 218 can be shaped and sized to contact the helmet shell 12 as the visor 102 is raised. As such, pressure applied on the nose cover 218 upon contacting the helmet shell 12 can cause the nose cover 218 to be inverted (i.e., turn inside-out) and extend downwardly (i.e., below the breath guard and/or visor interfaces 106, 202). It should thus be understood that, upon raising the visor 102 from the lowered position, contact between the helmet shell 12 and the flexible member 204 can "drag" the nose cover 218 downwardly due to the adherence of the rubber material on the helmet shell 12, therefore inverting the nose cover 218.

In some embodiments, when the breath guard is in the first configuration, the nose cover 218 can extend above the visor interface 202 by a first distance, such as about 3 inches, for example. When the breath guard is moved into the second configuration, the nose cover 218 can be deformed (e.g., pulled/dragged downwardly) so as to extend below the visor interface 202 by a second distance which can be greater than the first distance. For example, the second distance can be about twice the first distance, although it is appreciated that the second distance can have any other lengths, preferably greater than the first distance. As seen in FIGS. 3, 9 and 10, when the breath guard 200 is in the second configuration, the nose cover 218 is substantially inverted, thereby exposing the bottom surface 224 to the surrounding environment. It should be appreciated that the shape, position and configuration of the channel 212 allow the nose cover 218 to be deformed as described above. More specifically, the V-shaped cross-section of the channel 212 improves the flexibility and range of movement of the flexible member 204.

Figure 8:
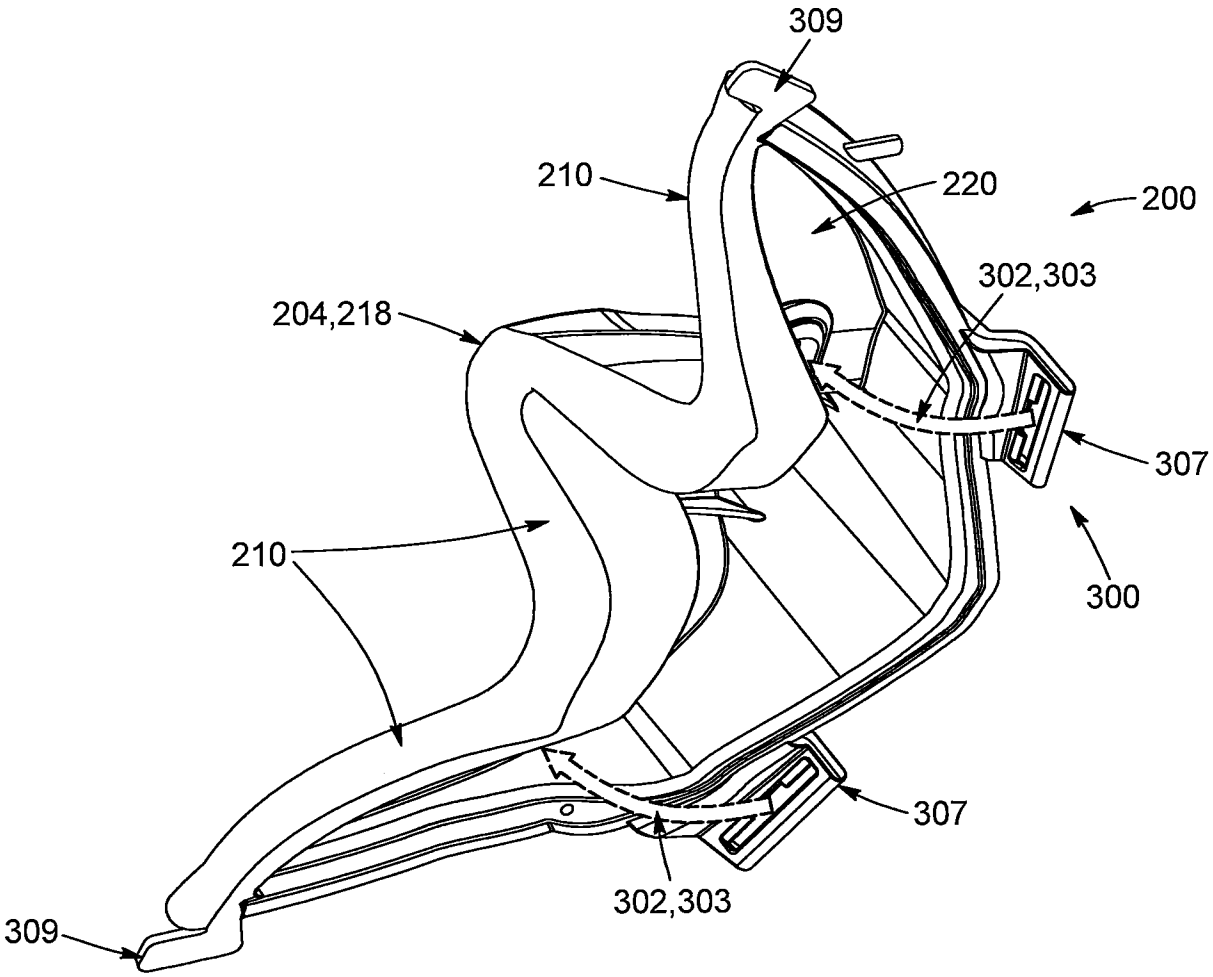
FIG. 8 is a bottom perspective view of the breath guard shown in FIG. 4, showing an adjustment mechanism according to an embodiment.

Now referring more specifically to FIG. 8, the breath guard 200 can include an adjustment mechanism 300 adapted to increase conformity of the breath guard 200 with the wearer's face, and thereby improve the seal provided to avoid humid air from contacting the inner surface of the visor 102, among others. In this embodiment, the adjustment mechanism 300 is operable for adjusting the flexible member 204 to improve conformity thereof with the wearer's face, therefore improving isolation of the wearer's nose and/or mouth from the inner surface of the visor. In other words, operating the adjustment mechanism 300 adjusts the flexible member 204 such that the contact surface 210 effectively contacts the wearer's face along an entire length thereof. In some embodiments, the adjustment mechanism 300 can include a strap assembly 302 manually operable to adjust the flexible member 204 as previously described. In this embodiment, the strap assembly 302 includes a pair of straps 303 extending between the wings 220 and the visor interface 202. It should thus be understood that operating the strap assembly 302 effectively adjusts the length of at least one strap 303 for either tightening or loosening the flexible member 204 onto the wearer's face.

The adjustment mechanism 300 can include a metallic strip (not shown) positioned within/across the nose cover 218 for manually adjusting the nose cover 218 to the shape of the wearer's nose. Breath guards provided with such a metallic strip, or other similar components adapted to be manually adjusted, are well known in the art. However, moving the visor and/or deforming the flexible member 204 can cause the metallic strip to inadvertently change shape, for example when the flexible member 204 contacts the helmet shell 12 upon raising the visor. The metallic strip can therefore require frequent adjustments, especially if the visor is raised and lowered during use of the helmet. The strap assembly 302 advantageously allows the flexible member 204 to retain the desired adjustment (i.e., the desired shape) when using the helmet 10. In other words, the strap assembly 302 allows the flexible member 204 to re-engage the wearer's face upon lowering the visor without having to adjust the straps 303 once more.

In this embodiment, the wings 220 of the flexible member 204 are each provided with a strap aperture 305 extending through at least the top surface 222 thereof. The strap apertures 305 can be shaped and configured to have a first end of a strap 303 be connected thereto. The visor interface 202 can be similarly provided with apertures, or strap receiving slots 307 positioned along the visor interface 202 for connecting a second end of the strap 303 thereto. In some embodiments, the strap receiving slots 307 are defined through a thickness of the visor interface 202, although it is appreciated that other configurations are possible. For example, and as seen in FIG. 8, the strap receiving slots 307 can extend downwardly from the visor interface 202 on either side of the nose cover 218.

In addition to the adjustment mechanism 300, the breath guard 200 can be provided with additional components adapted to improve the seal between a bottom portion and a top portion of the cavity (i.e., between the visor 102 and the nose and/or mouth of the wearer). For example, in this embodiment, the flexible member 204 includes one or more sealing protrusions 309 extending outwardly therefrom for engaging the visor assembly 100 and/or the helmet shell 12 for creating a seal therebetween and prevent humid air from contacting the inner surface of the visor (e.g., prevent the visor from fogging up). In this embodiment, the flexible member 204 includes two sealing protrusions 309 extending from the ends of the wings 220 (i.e., from each end of the contact surface 210), although it is appreciated that other configurations are possible.

It should be appreciated from the present disclosure that the breath guard as described herein can offer improvements and advantages. Indeed, the shape and configuration of the breath guard 200 and related components presents multiple advantages. For example, the shape and configuration of the channel 212 allows for greater deformability/flexibility of the flexible member 204, therefore increasing the range of movements, thus allowing a wearer to fully raise the visor 102. Moreover, fully raising the visor can effectively increase the field of vision of the wearer while simultaneously moving the global center of gravity of the helmet towards the neck of the wearer, therefore reducing stress thereon and increasing overall comfort of the helmet. Additionally, the increased flexibility of the flexible member 204 can prevent, or at least reduce damages caused to the breath guard due to repetitive contact with the helmet shell and deformation thereof. Furthermore, having a static chin guard effectively reduces the weight of the helmet, therefor further reducing stress on the neck of the wearer, and increasing comfort.

Finally, the breath guard 200 is provided with its own standalone adjustment mechanism 300 operable to improve isolation of the wearer's nose and/or mouth from the inner surface of the visor. Known mechanisms or methods for reducing fog accumulation on one or more surfaces of the visor can be complex and/or require additional components such as heat generating members and electricity for example (e.g., electric goggles/visors). The present adjustment mechanism 300 is advantageously configured to adjust the structure of the breath guard itself for reducing fog accumulation on the visor.

While the breath guard 260 has been described in conjunction with the exemplary embodiments described above, many equivalent modifications and variations will be apparent to those skilled in the art. For example, the exemplary embodiments described above describe a breath guard connected to a visor assembly, however, the breath guard can alternatively be connected to an inner surface of the helmet shell, such as the chin guard for example. It is appreciated that, in such embodiments, the front portion of the helmet can be opened upon lifting the chin guard, which raises the breath guard along with it. Accordingly, the exemplary embodiments set forth above are considered to be illustrative and not limiting. The scope of the claims should not be limited by the preferred embodiments set forth in this disclosure but should be given the broadest interpretation consistent with the description as a whole.

The invention claimed is:

1. A helmet comprising:

a helmet shell defining a cavity for receiving a wearer's head and having a front opening;

a visor assembly comprising:

a visor pivotally connected to the helmet shell and being movable between a lowered position for covering the front opening, and a raised position, the visor having an inner surface facing the cavity when in the lowered position; and wherein in the raised position, a gap is defined between the visor and a top surface of the helmet shell;

a breath guard interface provided below the visor or proximate a lower portion thereof; and a breath guard, comprising:

a visor interface connectable to the breath guard interface of the visor assembly; and a flexible member having a nose cover shaped and sized for covering the wearer's nose, and a pair of wings extending on opposed sides of the nose cover, the flexible member further having:

a front portion extending from the visor interface; and a rear portion extending rearwardly from the front portion, the rear portion having a contact surface shaped and configured to engage the wearer's face around the nose and/or mouth for deflecting humid air away from the inner surface of the visor when the visor is in the lowered position, the front portion being provided with a channel extending along the visor interface, the channel having a substantially V-shaped cross-section configured to allow the flexible member to be deformed and have the breath guard at least partially fit within the gap defined between the visor and top surface of the helmet shell when the visor is raised, the channel being defined by a first sidewall and a second sidewall connected to one another at a bottom surface, the bottom surface being lower than a lowermost surface of the nose cover when the visor is in the lowered position.

2. The helmet according to claim 1, wherein the breath guard is operable between a first configuration where the nose cover extends above the visor interface by a first distance, and a second configuration where the nose cover extends below the visor interface by a second distance, the second distance being greater than the first distance.

3. The helmet according to claim 2, wherein the second distance is about twice the first distance.

4. The helmet according to claim 1, wherein the breath guard comprises an adjustment mechanism operable for adjusting the flexible member to conform to the wearer's face and further isolate the wearer's nose and/or mouth from the inner surface of the visor, the adjustment mechanism being disposed within the front portion of the flexible member.

5. The helmet according to claim 4, wherein the adjustment mechanism comprises a strap assembly comprising a pair of straps respectively connecting one of the wings of the flexible member to the visor interface, whereby operating the strap assembly adjusts a length of the straps for retaining the desired shape of the flexible.

6. The helmet according to claim 1, wherein the visor interface is removably connectable to the breath guard interface via a snap-fit connection.

7. The helmet according to claim 1, wherein the flexible member is made of at least one elastomeric material adapted to allow the flexible member to revert back to its initial shape after being deformed.

8. The helmet of claim 1, wherein the nose cover has a bottom surface and a top surface, and wherein when the visor is in the raised position, the nose cover is inverted, the bottom surface being exposed to surrounding environment, and the top surface facing the helmet shell.

9. The helmet of claim 8, wherein portions of the flexible member surrounding the nose cover are stretched when the visor is in the raised position.

10. The helmet of claim 1, wherein the contact surface delineating the nose cover has a nose-configured shape when the visor is in the lowered position and a flattened shape when the visor is in the raised position.

11. A breath guard connectable to a visor of a helmet for deflecting humid air away from an inner surface of the visor, the breath guard comprising:

a visor interface operatively connected to a breath guard interface of the visor; and a flexible member having a nose cover shaped and sized for covering the wearer's nose, and a pair of wings extending on opposed sides of the nose cover, the flexible member further having:

a front portion extending from the visor interface; and a rear portion extending rearwardly from the front portion, the rear portion having a contact surface shaped and configured to engage the wearer's face around the nose and/or mouth for deflecting humid air away from the inner surface of the visor when the visor is in the lowered position, the front portion being provided with a channel extending along the visor interface, the channel having a substantially V-shaped cross-section configured to allow the flexible member to be deformed and have the breath guard at least partially fit within the gap defined between the visor and top surface of the helmet when the visor is raised, the channel being defined by a first sidewall and a second sidewall connected to one another at a bottom surface, the bottom surface being lower than a lowermost surface of the nose cover when the breath guard is in use on the wearer's face.

12. The breath guard according to claim 11, wherein the breath guard is operable between a first configuration where the nose cover extends above the visor interface by a first distance, and a second configuration where the nose cover extends below the visor interface by a second distance, the second distance being greater than the first distance.

13. The breath guard according to claim 12, wherein the second distance is about twice the first distance.

14. The breath guard according to claim 11, wherein the breath guard comprises an adjustment mechanism operable for adjusting the flexible member to conform to the wearer's face and isolate the wearer's nose and mouth from the internal surface of the visor, the adjustment mechanism being provided within the front portion of the flexible member.

15. The breath guard according to claim 14, wherein the adjustment mechanism comprises a strap assembly comprising a pair of straps respectively connecting one of the wings of the flexible member to the visor interface such that operating the strap assembly adjusts a length of the straps for retaining the desired shape of the flexible member.

16. The breath guard according to claim 11, wherein the front portion of the channel has a forwardly projecting top edge adapted to extend within a complementary-shaped portion of the breath guard interface.

17. The breath guard according to claim 11, wherein the flexible member is made of at least one elastomeric material adapted to allow the flexible member to revert back to its initial shape after being deformed.

18. The breath guard of claim 11, wherein the channel is formed as a furrow, a recess or with several folds and creases.

19. A visor assembly of a helmet having a helmet shell defining a cavity, the visor assembly comprising:

a visor pivotally connected to the helmet shell and being movable between a lowered position for substantially covering the front opening, and a raised position thereby defining a gap between the visor and the helmet shell, the visor having an inner surface facing the cavity when in the lowered position; and a breath guard interface provided below the visor; and a breath guard, comprising:

a visor interface connectable to the breath guard interface; and a flexible member having a nose cover shaped and sized for covering the wearer's nose, and a pair of wings extending on opposed sides of the nose cover, the flexible member further having:

a front portion extending from the visor interfaces; and a rear portion extending rearwardly from the front portion, the rear portion having a contact surface shaped and configured to engage the wearer's face around the nose and/or mouth for deflecting humid air away from the inner surface of the visor when the visor is in the lowered position, the front portion being provided with a channel extending along the visor interface, the channel having a substantially V-shaped cross-section configured to allow the flexible member to be deformed and have the breath guard at least partially fit within the gap defined between the visor and top surface of the helmet shell when the visor is raised, the channel being defined by a first sidewall and a second sidewall connected to one another at a bottom surface, the bottom surface being lower than a lowermost surface of the nose cover when the visor is in the lowered position.

20. The visor assembly according to claim 19, wherein when the breath guard is operable between a first configuration where the nose cover extends above the visor interface by a first distance, and a second configuration where the nose cover extends below the visor interface by a second distance, the second distance being greater than the first distance.

21. The visor assembly according to claim 20, wherein the second distance is about twice the first distance.

22. The visor assembly according to claim 19, wherein the breath guard comprises an adjustment mechanism operable for adjusting the flexible member to conform to the wearer's face and further isolate the wearer's nose and mouth from the internal surface of the visor, the adjustment mechanism being disposed within the front portion of the flexible member.

23. The visor assembly according to claim 22, wherein the adjustment mechanism comprises a strap assembly comprising a pair of straps respectively connecting one of the wings of the flexible member to the visor interface such that operating the strap assembly adjusts a length of the straps for, retaining the desired shape of the flexible member.

24. The visor assembly according to claim 19, wherein the visor interface is removably connectable to a breath guard interface of the visor assembly via a snap-fit connection.

25. The visor assembly according to claim 24, wherein the front portion of the channel of the breath guard has a forwardly projecting top edge and the breath guard interface has a complementary-shaped portion of the breath guard interface.

26. The visor assembly according to claim 19, wherein the flexible member is made of at least one elastomeric material adapted to allow the flexible member to revert back to its initial shape after being deformed.

* * * * *